US006443113B1

(12) United States Patent
Kanada et al.

(10) Patent No.: US 6,443,113 B1
(45) Date of Patent: Sep. 3, 2002

(54) VARIABLE VALVE TIMING SYSTEM

(75) Inventors: Yoji Kanada, Gamagori; Osamu Komazawa, Chita, both of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/957,508

(22) Filed: Sep. 21, 2001

(30) Foreign Application Priority Data

Sep. 22, 2000 (JP) ..... 2000-289400

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS 6,053,139 A * 4/2000 Eguchi et al. ..... 123/90.17
6,058,897 A * 5/2000 Nakayoshi ..... 123/90.17
6,302,072 B1 * 10/2001 Sekiya et al. ..... 123/90.17

FOREIGN PATENT DOCUMENTS

JP 9-324613 12/1997

* cited by examiner

*Primary Examiner*—Weilun Lo
(74) *Attorney, Agent, or Firm*—Burns, Doane, Swecker & Mathis, LLP

(57) ABSTRACT

A variable valve timing system includes a first controlling mechanism through which operation fluid is supplied to and discharged from an advanced angle chamber to restrict the relative rotation to an advanced angle side at the lock phase, and a second controlling mechanism through which operation fluid is supplied to and discharged from a retarded angle chamber to restrict the relative rotation to a retarded angle side at the lock phase. The variable valve timing system further includes passages which function as a throttle at the lock phase to connect the advanced angle chamber with the first controlling mechanism and the retarded angle chamber with the second controlling mechanism.

16 Claims, 5 Drawing Sheets

VARIABLE VALVE TIMING SYSTEM

This application is based on and claims priority under 35 U.S.C. §119 with respect to Japanese Application 2000-289400 filed on Sep. 22, 2000, the entire content of which is incorporated herein by reference.

FIELD OF THE INVENTION

This invention generally relates to a variable valve timing system of an internal combustion engine. More particularly, the present invention pertains to a variable valve timing system for controlling the opening and closing timing of an intake valve and an exhaust valve in an internal combustion engine.

BACKGROUND OF THE INVENTION

A known variable valve timing system is disclosed in Japanese Patent Laid-Open Publication No. 09(1997) 324613 published on Dec. 16, 1997. The disclosed variable valve timing system includes a housing member rotating as a unit with either a crankshaft or a camshaft of the internal combustion engine, and a rotor member rotating as a unit with either the camshaft or crankshaft. The rotor member is rotatably assembled on a shoe portion provided at the housing member and forms an advanced angle chamber and a retarded angle chamber at a vane portion in the housing member. The variable valve timing system also includes a relative rotation controlling mechanism which allows relative rotation of the housing member and the rotor member by an unlock operation the supply of an operation fluid. The relative rotation controlling mechanism also restricts relative rotation of the housing member and the rotor member by a lock operation through the discharge of the operation fluid at a lock phase within an intermediate area from a most advanced angle phase to a most retarded angle phase excluding rotation limited phases at both ends. The variable valve timing system further includes a fluid pressure circuit for controlling the operation fluid to be supplied to and discharged from the advanced angle chamber, the retarded angle chamber, and the relative rotation controlling mechanism.

In the above-mentioned variable valve timing system, the passage connecting the advanced angle chamber and the relative rotation controlling mechanism with the fluid pressure circuit, and the passage connecting the retarded angle chamber and the relative rotation controlling mechanism with the fluid pressure circuit always communicate under the same condition. The fluid pressure of the operation fluid supplied to the advanced angle chamber and the relative rotation controlling mechanism, or the fluid pressure of the operation fluid supplied to the retarded angle chamber and the relative rotation controlling mechanism are each approximately the same pressure all the time. Accordingly, when the relative rotation of the rotor member and the housing member is restricted at the lock phase by the relative rotation controlling mechanism, when the operation fluid is rapidly supplied (phase control for quick response) to the advanced angle chamber through the relative rotation controlling mechanism or to the retarded angle chamber through the relative rotation controlling mechanism both from the fluid pressure circuit, the relative rotation of the rotor member and the housing member is started before the unlock operation of the relative rotation controlling mechanism is completed. Thus a lock member of the relative rotation controlling mechanism can be caught in the relative rotation of the rotor member and the housing member.

Additionally, in the above-mentioned variable valve timing system, the rotor member is rotated by the fluctuation torque of the camshaft in the lock phase, and the pressure of the operation fluid filled in the advanced angle chamber or the retarded angle chamber is increased because the volume of the advanced angle chamber or the retarded angle chamber becomes smaller by the rotation of the vanes. The increased pressure of the operation fluid causes movement of the lock member (unlock operation) and unintended operation of the relative rotation controlling mechanism.

In light of the foregoing, a need exists for an improved variable valve timing system which is not as susceptible to the drawbacks discussed above.

SUMMARY OF THE INVENTION

According to one aspect of the invention, a variable valve timing system includes a housing member rotatable as a unit with either a crankshaft or a camshaft of an internal combustion engine, and a rotor member relatively rotatably assembled on a shoe portion of the housing member and forming an advanced angle chamber and a retarded angle chamber at a vane portion in the housing member, with the rotor member rotating as a unit with either the crankshaft or the camshaft of the internal combustion engine. A relative rotation controlling mechanism allows relative rotation of the housing member and the rotor member by an unlock operation through supply of an operation fluid, and restricts relative rotation of the housing member and the rotor member by a lock operation through discharge of the operation fluid at a lock phase within an intermediate area from a most advanced angle phase to a most retarded angle phase excluding rotation limited phases at both ends. A fluid pressure circuit controls the operation fluid to be supplied to and discharged from the advanced angle chamber, the retarded angle chamber, and the relative rotation controlling mechanism. The relative rotation controlling mechanism includes a first controlling mechanism restricting the relative rotation to an advanced angle side when the first controlling mechanism is operated under the lock operation at the lock phase, and a second controlling mechanism restricting the relative rotation to a retarded angle side when the second controlling mechanism is operated under the lock operation at the lock phase. The fluid pressure circuit supplies and discharges the operation fluid to or from the advanced angle chamber through the first controlling mechanism, and supplies and discharges the operation fluid to or from the retarded angle chamber through the second controlling mechanism. A first passage connects the advanced angle chamber with the first controlling mechanism and functions as a throttle, and a second passage connects the retarded angle chamber with the second controlling mechanism and functions as a throttle.

When used in a variable valve timing system for an automobile, the throttle function of the advanced angle side and the retarded angle side is desirably canceled when the rotor member is rotated relative to the housing member to the advanced angle side or the retarded angle side from the lock phase by more than a predetermined amount.

At an early stage of starting of the internal combustion engine, the operation fluid is not sufficiently discharged from the fluid pressure circuit to each advanced angle chamber, each retarded angle chamber, the first controlling mechanism, and the second controlling mechanism. Thus, the relative rotation phase of the rotor member to the housing member cannot be adjusted or maintained. If the relative rotation phase of the rotor member to the housing member is not positioned at the intermediate lock phase, the housing member and the rotor member are relatively rotated by torque fluctuation affecting the camshaft. In this manner, when the relative rotation phase of the rotor member to the housing member is positioned at the intermediate lock phase, the relative rotation to the advanced angle side is restricted by the first controlling mechanism, and the relative rotation to the retarded angle side is restricted by the second controlling mechanism. Then the relative rotation of the housing member and the rotor member is restricted and maintained at the intermediate lock phase by the first controlling mechanism and the second controlling mechanism, and the starting performance of the internal combustion engine is improved.

As explained above, when relative rotation of the housing member and the rotor member is restricted by the first controlling mechanism and the second controlling mechanism at the intermediate lock phase, when the operator fluid is sufficiently supplied to each advanced angle chamber through the first controlling mechanism from the fluid pressure circuit, or to each retarded angle chamber through the second controlling mechanism from the fluid pressure circuit, the first passage connecting the advanced angle chamber which the first controlling mechanism functions as a throttle and the second passage connecting the retarded angle chamber with the second controlling mechanism also functions as a throttle.

Accordingly, in the passages to which the operation fluid is supplied, the fluid pressure provided to the first controlling mechanism or the second controlling mechanism is instantly obtained, and the unlock operation is immediately conducted. At the same time, the supply of operation fluid is controlled to the advanced angle chamber and the retarded angle chamber by the throttle function of both passages. Then the relative rotation of the housing member and the rotor member is relatively slower compared to the unlock operation. Thus, when the phase is controlled for quick response, the lock members of the first controlling mechanism and the second controlling mechanism cannot be caught in the relative rotation of the housing member and the rotor member.

When the rotor member is rotated to the advanced angle side or the retarded angle side from the lock phase relative to the housing member by more than the predetermined amount, the throttle function of the advanced angle side and the retarded angle side is configured to be canceled. Thus at the lock phase, the throttle function is effectively operated, and when the rotor member is rotated relative to the housing member to the advanced angle side or the retarded angle side from the lock phase by more than the predetermined amount, the operation fluid is thoroughly supplied to the advanced angle chamber from the first controlling mechanism or to the retarded angle chamber from the second controlling mechanism. Then the rotor member is relatively rotated to the housing member with a good response. Accordingly, a reliable or certain unlock operation and good response can be obtained.

According to another aspect of the invention, a variable valve timing system includes a housing member rotatable as a unit with either a crankshaft or a camshaft of an internal combustion engine, and a rotor member relatively rotatably assembled on a shoe portion of the housing member and forming an advanced angle chamber and a retarded angle chamber at a vane portion in the housing member, with the rotor member rotating as a unit with either the crankshaft or the camshaft of the internal combustion engine. A relative rotation controlling mechanism allows relative rotation of the housing member and the rotor member by an unlock operation through supply of an operation fluid, and restricts relative rotation of the housing member and the rotor member by a lock operation through discharge of the operation fluid at a lock phase within an intermediate area from a most advanced angle phase to a most retarded angle phase excluding rotation limited phases at both ends. A fluid pressure circuit controls the operation fluid to be supplied to and discharged from the advanced angle chamber, the retarded angle chamber, and the relative rotation controlling mechanism. The relative rotation controlling mechanism includes a first controlling mechanism restricting the relative rotation to an advanced angle side when the first controlling mechanism is operated under the lock operation at the lock phase, and a second controlling mechanism restricting the relative rotation to a retarded angle side when the second controlling mechanism is operated under the lock operation at the lock phase. The fluid pressure circuit supplies and discharges the operation fluid to or from the advanced angle chamber through the first controlling mechanism, and supplies and discharges the operation fluid to or from the retarded angle chamber through the second controlling mechanism. A first passage having a first narrow portion communicates between the advanced angle chamber and the first controlling mechanism, and a second passage having a second narrow portion communicates between the retarded angle chamber and the second controlling mechanism.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

Figure 2:
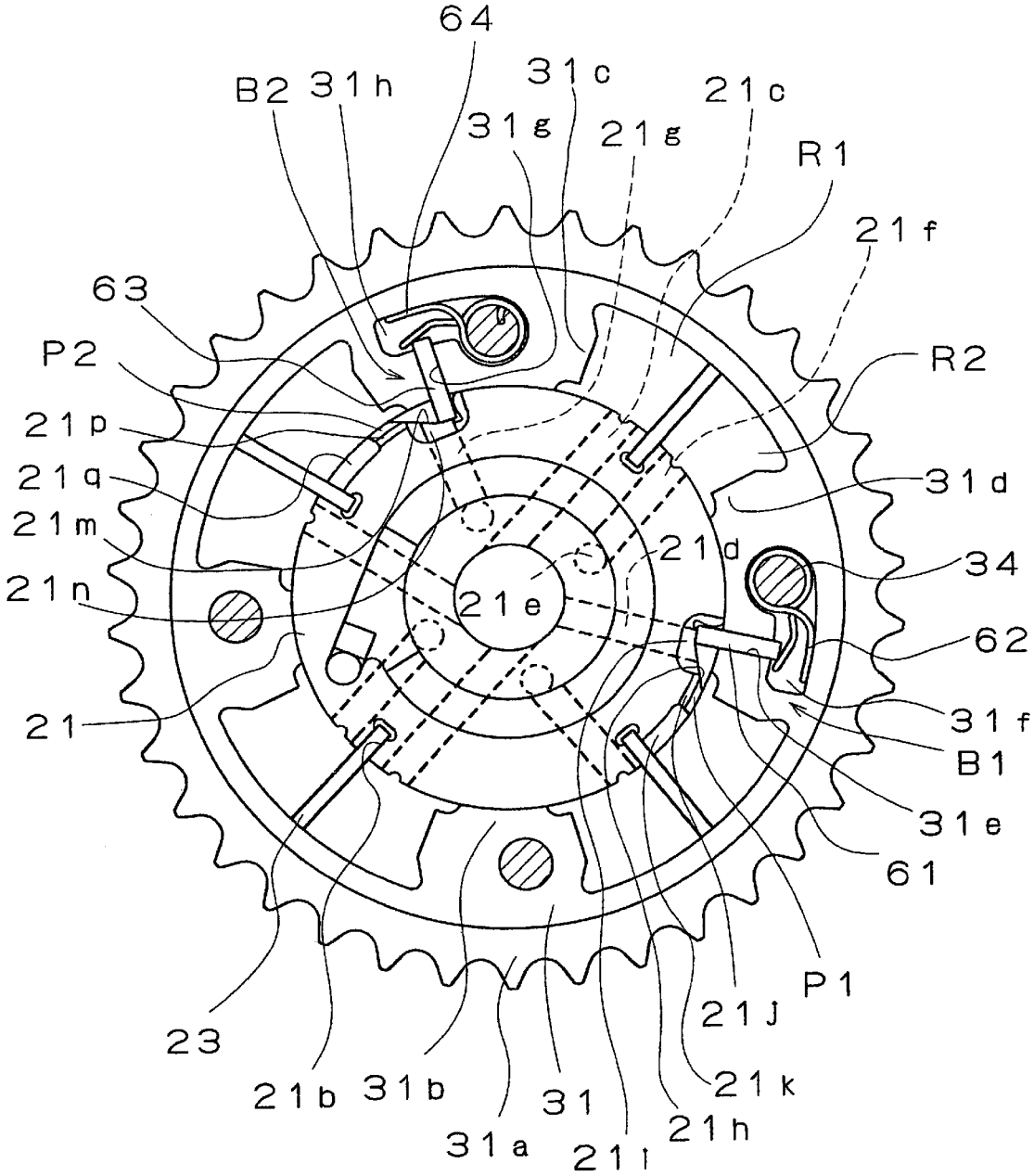
FIG. 2 is a cross-sectional view of a portion of the variable valve timing system shown in FIG. 1 viewed from the front.
Figure 4:
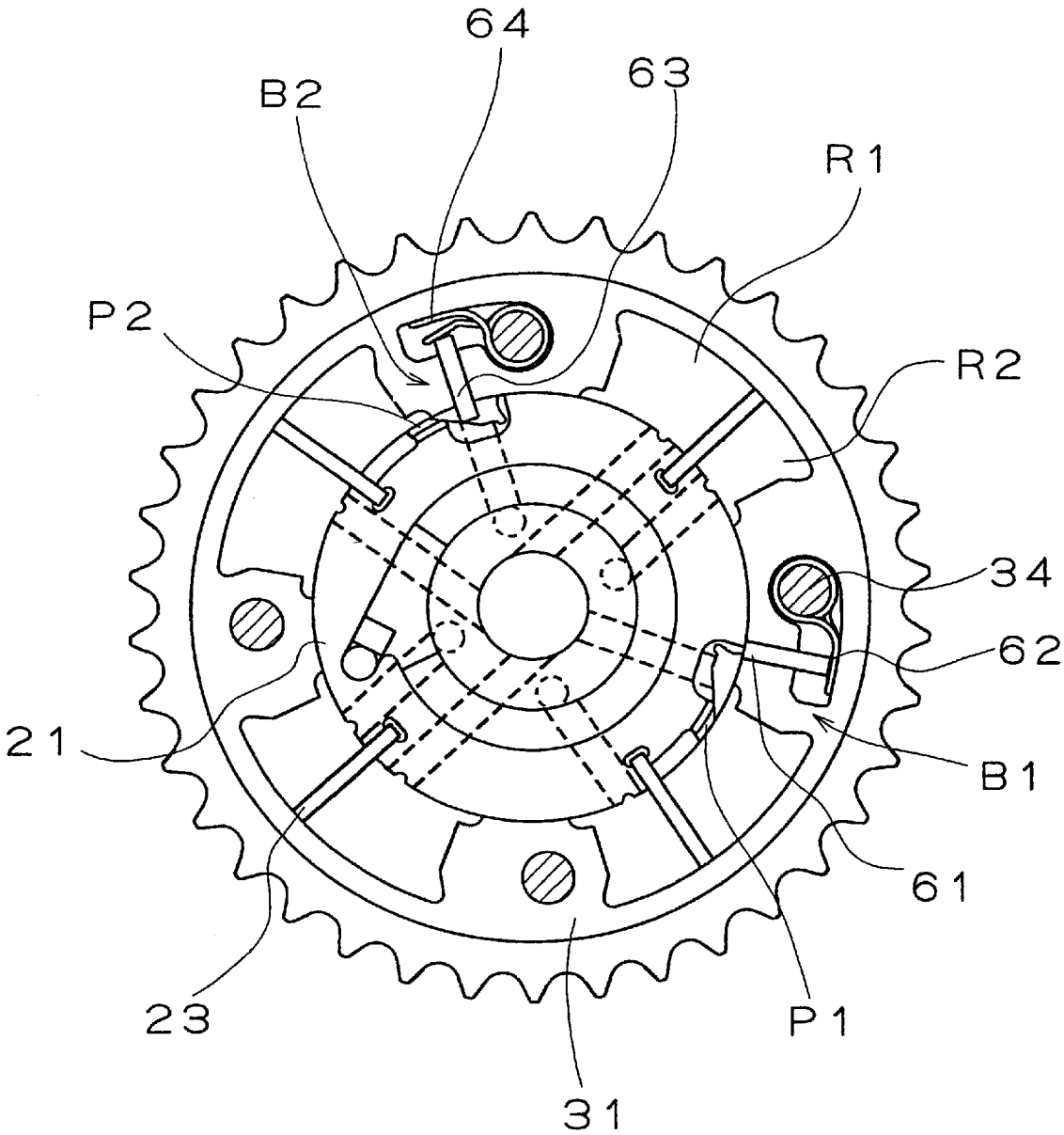
Figure 5:
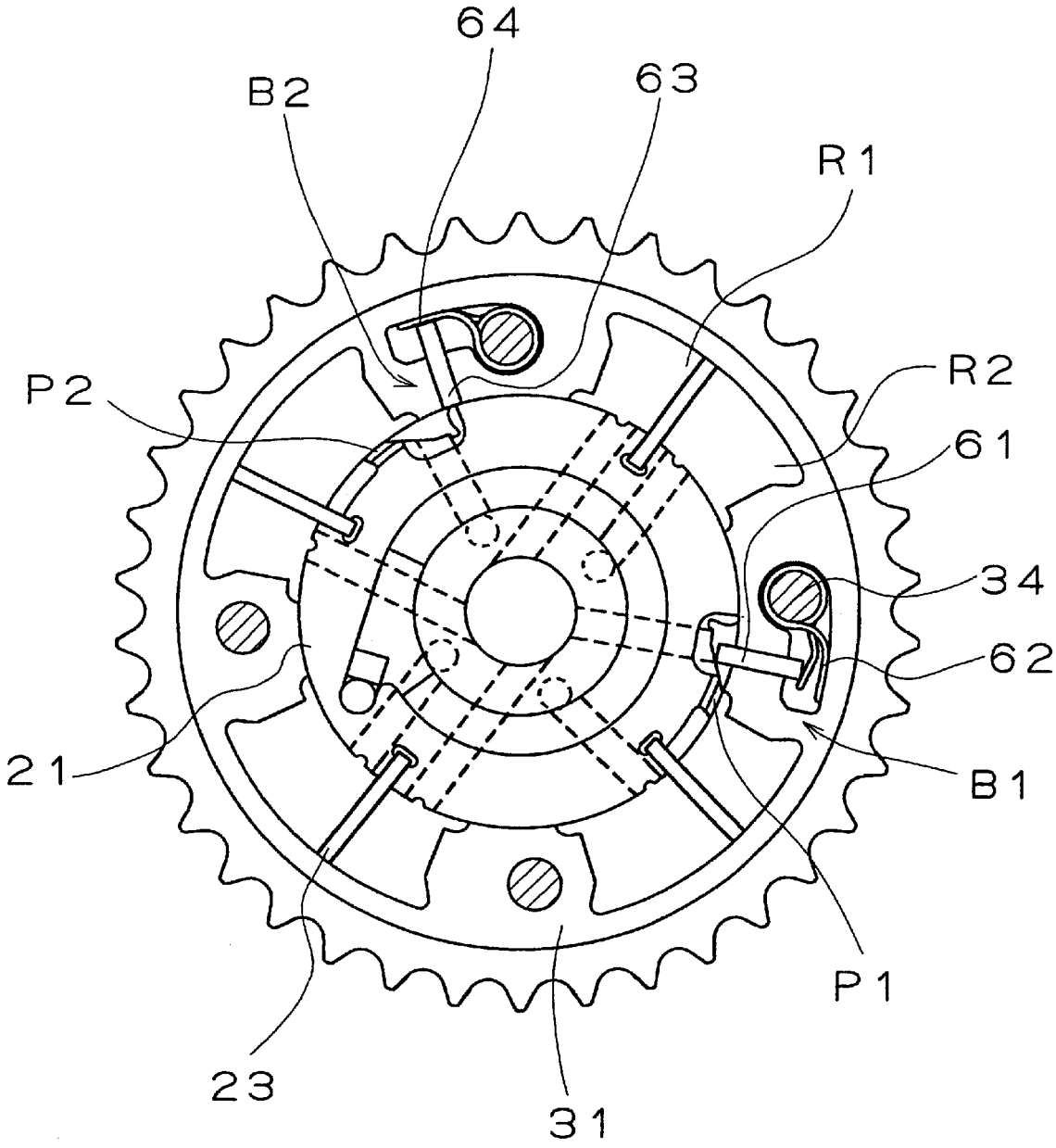

FIG. 4 shows an operational position of the main rotor shown in FIG. 2 in which the main rotor is rotated a predetermined amount relative to a housing body to the advanced angle side from an intermediate lock phase; and FIG. 5 shows an operational position of the main rotor shown in FIG. 2 in which the main rotor is rotated a predetermined amount relative to a housing body to the retarded angle side from an intermediate lock phase.

DETAILED DESCRIPTION OF THE INVENTION

Figure 1:
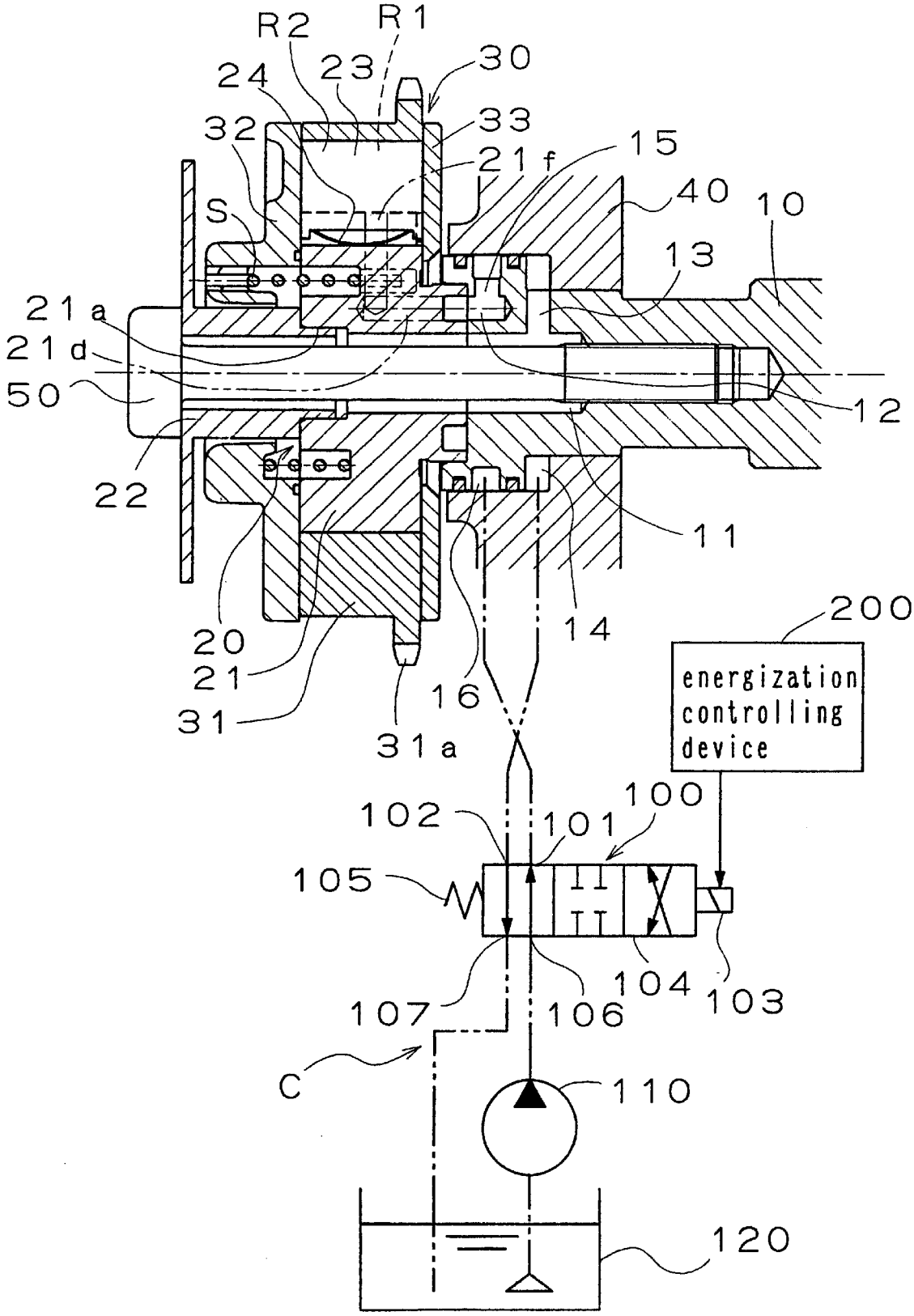
FIG. 1 is a schematic illustration of a variable valve timing system according to an embodiment of the present invention.

Referring initially to FIGS. 1 and 2, the variable valve timing system in accordance with the present invention includes a rotor member 20 assembled as a unit with an end portion (left side in FIG. 1) of a camshaft 10 in an internal combustion engine, and a housing member 30 supported by the rotor member 20 for rotation within a predetermined range. The variable valve timing system also includes a torsion spring S disposed between the housing member 30 and the rotor member 20, and a first controlling mechanism B1 and a second controlling mechanism B2 forming a relative rotation controlling mechanism for restricting relative rotation of the housing member 30 and the rotor member 20. The variable valve timing system further includes a fluid pressure circuit C for controlling operation fluid to be supplied to and discharged from the first controlling mechanism B1 and the second controlling mechanism B2. The fluid pressure circuit C also controls operation fluid to be supplied to or discharged from advanced angle chambers R1 and retarded angle chambers R2, the details of which will be described below.

The camshaft 10 having a known cam for controlling the opening and closing of an intake valve is rotatably supported by a cylinder head 40 of the internal combustion engine. An advanced angle passage 11 and a retarded angle passage 12 are provided in the camshaft 10 and extend in the axial direction. The advanced angle passage 11 is connected with a connecting port 102 of a fluid pressure controlling valve 100 through a radially extending passage 13 and an annular passage 14. The retarded angle passage 12 is connected with a connecting port 101 of the fluid pressure controlling valve 100 through a radially extending passage 15 and an annular passage 16. The radially extending passages 13, 15 and the annular passage 16 are formed in the camshaft 10 and the annular passage 14 is formed in a stepped portion between the camshaft 10 and the cylinder head 40.

The rotor member 20 includes a main rotor 21 and a front rotor 22 which is assembled on the front of the main rotor 21 (i.e., the left side of the main rotor 21 in FIG. 1) as a unit and has a cylindrical shape with a stepped portion. The rotor member 20 is engaged with or connected to the front end of the camshaft 10 as a unit by a bolt 50. The central inner bores of the main motor 21 and the front rotor 22 are connected with the advanced angle passage 11 provided in the camshaft 10 being blocked by a head portion of the bolt 50 at the front end.

The main rotor 21 is provided with an inner bore 21*a* coaxially assembled with the front rotor 22, and four vane grooves 21*b* for receiving respective vanes 23 and for assembling a spring 24 (shown in FIG. 1) biasing the four vanes 23 outward in the radial direction. Each vane 23 assembled in the respective vane groove 21*b* extends outwardly in the radial direction and divides respective spaces in the housing member 30 into one of the advanced angle chambers R1 and one of the retarded angle chambers R2.

The main rotor 21 includes three passages 21*c* extending generally in the radial direction which communicate with the advance angle passage 11 at the radial inner end through the central inner bore and communicate with a respective one of the advanced angle chambers R1 at the radial outer end. The main rotor 21 also includes a radially extending passage 21*d* in communication with the advanced angle passage 11 at the radial inner end through the central inner bore and in communication with one of the advanced angle chambers R1 at the radial outer end through the first controlling mechanism B1 and a passage P1.

The main rotor 21 further include four axially extending passages 21*e* in communication with the retarded angle passage 12, three radially extending passages 21*f* each communicating with one of the respective passages 21*e* at the radial inner end and communicating with one of the respective retarded angle chambers R2 at the radial outer end. Moreover, the main rotor 21 includes a passage 21*g* in communication with one of the passages 21*e* at the radial inner end and in communication with one of the retarded angle chambers R2 at the radial outer end through the second controlling mechanism B2 and a passage P2.

The housing member 30 is provided with a housing body 31, a front plate 32, and a rear thin plate 33. Four bolts 34 which are shown in FIG. 2 connect the housing body 31, the front plate 32 and the rear thin plate 33 as a unit. The outer periphery of the housing body 31 is provided with a sprocket 31*a*. The sprocket 31*a* is connected to a crankshaft of the internal combustion engine through a timing chain and is rotated in the clockwise direction in FIG. 2 by the driving force transmitted from the crankshaft.

The housing body 31 is provided with four shoe portions 31*b* projecting inward in the radial direction and rotatably supporting the main rotor 21 at the radial inner end of each shoe portion 31*b*. The axially opposing end surfaces of the front plate 32 and the rear thin plate 33 are slidably in contact with the outer peripheral end surfaces of the main rotor 21 and the end surfaces of the vanes 23. As shown in FIG. 2, the housing body 31 is also provided with a projection 31*c* defining the most retarded angle phase and a projection 31*d* defining the most advanced angle phase through contact with the vanes 23.

Through unlock operation of the first controlling mechanism B1 by the supply of the operation fluid from the advanced angle passage 11, the relative rotation of the housing member 30 and the rotor member 20 is allowed. Also, through the lock operation of the first controlling mechanism B1 by the discharge of the operation fluid to the advanced angle passage 11, the relative rotation of the housing member 30 and the rotor member 20 to the advanced angle side is restricted at the intermediate lock phase (the condition shown in FIG. 2) between the most advanced angle phase and the most retarded angle phase. The first controlling mechanism B1 includes a lock plate 61 and a lock spring 62.

The lock plate 61 is slidably movable in the radial direction within a radial retracting groove 31*e* formed in the housing body 31. The lock plate 61 is biased to be projected from the retracting groove 31*e* by the lock spring 62 accommodated in a receiving portion 31*f* of the housing body 31. The receiving portion 31*f* of the housing body 31 is atmospherically open through an open bore (not shown) provided at the rear thin plate 33. Accordingly, smooth movement of the lock plate 61 in the radial direction is assured.

The end portion or radial inner end of the lock plate 61 is slidably and detachably (i.e., can be disposed and detached) supported in a lock groove 21*h* formed in the main rotor 21. By the supply of the operation fluid to the lock groove 21*h*, the lock plate 61 is moved in the radial direction and received in the retracting groove 31*e* by overcoming the biasing force (predetermined as a small value) of the lock spring 62. The end portion of the lock plate 61 can be in contact with a bottom surface of the lock groove 21*h* or the outer periphery of the main rotor 21, and is slidably movable in the peripheral direction under the contacting condition.

When the rotor member 20 is positioned at the intermediate lock phase relative to the housing member 30 as shown in FIG. 2, the deepest end portion (the advanced angle side) of the lock groove 21*h* is opposed to the retracting groove 31*e*. The bottom surface of the lock groove 21*h* becomes gradually shallower and is sloped toward the retarded angle side, and the axial end portion of the lock groove 21*h* is formed with a recess potion 21*i* where the operation fluid can be stored. Because the bottom portion of the lock groove 21*h* is sloped (toward the radial outer direction from the radial inner direction), the lock plate 61 runs on the outer periphery of the main rotor 21 and is slidably moved thereon. Accordingly, the movement amount of the lock plate 61 in peripheral direction relative to the displacement amount of the rotor member 20 can be assured without the lock groove 21*h* being extended in the peripheral direction. The area of the advanced angle chambers R1 and the area of the retarded angle chambers R2 can be larger and also the displacement amount (displacement angle) of the vanes 23 can be larger. The lock groove 21*h* is in communication with the advanced angle passage 11 through the radially extending passage 21*d* and is in communication with the advanced angle chamber R1 through the peripherally extending passage P1.

Figure 3:
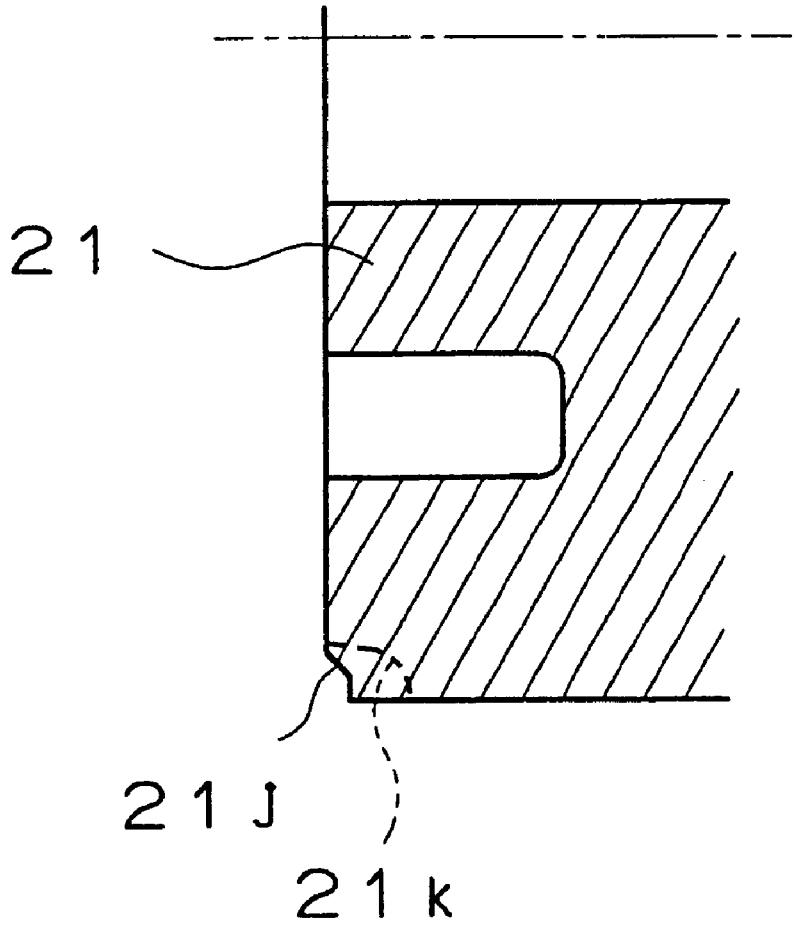
FIG. 3 is a cross-sectional view of a portion of the variable valve timing system shown in FIG. 2 illustrating the structure of a passage connecting the first control mechanism with the advanced angle chamber.

When the rotor member 20 is rotated from the intermediate lock phase as shown in FIG. 2 to the most retarded angle phase or to the advanced angle side relative to the housing member 30 with a predetermined amount, the lock groove 21*h* and the advanced angle chamber R1 are connected to each other through the passage P1. As shown in FIGS. 2 and 3, the passage P1 is provided with a small notch 21*j* and a large notch 21*k* in series in the peripheral direction and formed on the outer end periphery in the axial direction of the main rotor 21. The small notch 21*j* functions as a throttle while the rotor member 20 is rotated to the advanced angle side from the intermediate lock phase relative to the housing member 30 over the predetermined amount. In this condition, the advanced angle chamber R1 communicates with the passage 21*d* and the lock groove 21*h* via the small notch 21*j* only. The quantity of operation fluid supplied to the advance angle chamber R1 is limited by the small notch 21*j*. Because the cross-sectional area of the small notch 21*j* is smaller than the cross-sectional area of the passage 21*d*, the small notch 21*j* operates like an orifice. Therefore, the small notch 21*j* functions as a throttle. When the rotor member 20 is relatively rotated to the advanced angle side more than the predetermined amount, the throttle function of the small notch 21*j* is canceled. That is, the small notch 21*j* is no longer connected with the shoe portion 31*b* and so the lock groove 21*h* is directly in communication with the advanced angle chamber R1, or the advanced angle chamber R1 communicates with the passage 21*d* and the lock groove 21 via the large notch 21*k*.

With the unlock operation of the second controlling mechanism B2 through the supply of the operation fluid from the retarded angle passage 12, the relative rotation of the housing member 30 and rotor member 20 is allowed. Also with the lock operation of the second controlling mechanism B2 through the discharge of operation fluid to the retarded angle passage 12, the relative rotation of the housing member 30 and the rotor member 20 to the retarded angle side is restricted at the intermediate lock phase (the condition shown in FIG. 2) between the most advanced angle phase and the most retarded angle phase. The second controlling mechanism B2 includes a lock plate 63 and a lock spring 64.

The lock plate 63 is slidable movable in the radial direction within a radial retracting groove 31*g* formed in the housing body 31. The lock plate 63 is biased to be projected from the retracting groove 31*g* by the lock spring 64 accommodated in a receiving portion 31*h* of the housing body 31. The receiving portion 31*h* of the housing body 31 is atmospherically open through an open bore (not shown) provided at the rear thin plate 33. Accordingly, smooth movement of the lock plate 63 in the radial direction is assured.

The end portion or radial inner end of the lock plate 63 is slidably and detachably (i.e., can be disposed in and detached from) supported in a lock groove 21*m* formed in the main rotor 221. Through the supply of the operation fluid to the lock groove 21*m*, the lock plate 63 is moved in the radial direction and is received in the retracting groove 31*g* by overcoming the biasing force (predetermined as a small value) of the lock spring 64. The end portion of the lock plate 63 can be in contact with the bottom surface of the lock groove 21*m* or the outer periphery of the main rotor 21, and is slidably movable in the peripheral direction under the contacting condition.

When the rotor member 20 is positioned at the intermediate lock phase relative to the housing member 30 as shown in FIG. 2, the deepest end portion (on the retarded angle side) of the lock groove 21*m* is opposed to the retracting groove 31*g*. The bottom surface of the lock groove 21*m* gets more shallow and is sloped toward the advanced angle side, and the axial end portion of the lock groove 21*m* is formed with a recess portion 21*n* where the operation fluid can be stored. Because the bottom portion of the lock groove 21*m* is sloped (toward the radial outer direction from the radial inner direction), the lock plate 63 runs on or moves along the outer periphery of the main rotor 21 and is slidably moved thereon. Accordingly, the movement amount of the lock plate 63 can be assured in the peripheral direction relative to the displacement amount of the rotor member 20 without the lock grove 21*m* being extended in the peripheral direction. The area of the advanced angle chambers R1 and the area of the retarded angle chambers R2 can be larger and also the displacement amount (displacement angle) of the vanes 23 can be larger. The lock grove 21*m* is in communication with the retarded angle passage 12 through the radially extending passage 21*g* and is in communication with the retarded angle chamber R2 through the peripherally extending passage P2.

When the rotor member 20 is rotated from the intermediate lock phase as shown in FIG. 2 to the most advanced angle phase or to the retarded angle side relative to the housing member 30 by the predetermined amount, the lock groove 21*m* and the retarded angle chamber R2 are connected each other through the passage P2. The passage P2 is provided with a small notch 21*p* and a large notch 21*q* arranged in series in the peripheral direction and formed on the outer end periphery in the axial direction of the main rotor 21. The small notch 21*p* functions as throttle while the rotor member 20 is rotated to the retarded angle side from the intermediate lock phase relative to the housing member 30 by the predetermined amount. When the rotor member 20 is relatively rotated to the retarded angle side by more than the predetermine amount, the throttle function of the small notch 21*p* is canceled. That is, because the small notch 21*p* is no longer connected with the shoe portion 31*b*, the lock groove 21*m* is directly in communication with the retarded angle chamber R2.

The tension spring S disposed between the housing member 30 and the rotor member 20 rotatably biases the rotor member 20 to the advanced angle side relative to the housing member 30. The biasing force of the torsion spring S is predetermined to be of such an amount as to cancel the force derived from a spring (not shown) biasing the intake valve towards the closing position, which eventually biases the camshaft 10 and the rotor member 20 towards the retarded angle side. Thus, good response can be obtained when the relative rotation phase of the rotor member 20 to the housing member 30 is varied to the advanced angle side.

The fluid pressure controlling valve 100 shown in FIG. 1 comprises a part of the fluid pressure circuit C together with an oil pump 110 and an oil reservoir 120 of the internal combustion engine. A spool 104 can be moved left from the position in FIG. 1 against the force of a spring 105 by the energization of a solenoid 103 in response to an output signal from an energization controlling device 200. By varying a duty value (%), the operation fluid can be controlled to be supplied to or discharged from the advanced angle passage 11, the retarded angle passage 12, the first controlling mechanism B1, and the second controlling mechanism B2.

The oil pump 110 is actuated by the internal combustion engine, whereby the operation fluid is supplied to a supply port 106 of the fluid pressure controlling valve 100 from the oil reservoir 120 of the internal combustion engine. The oil reservoir 120 of the internal combustion engine is connected with a discharge port 107 of the fluid pressure controlling valve 100. The operation fluid is thus returned from the discharge port 107 to the reservoir 120. The energization controlling device 200 controls the output (duty value) based on detected signals from various sensors, including sensors for detecting the crank angle, the cam angle, the throttle opening degree, the engine rpm, the temperature of the engine cooling water and the vehicle speed, in response to the operation condition of the internal combustion engine by following a predetermined controlling pattern.

According to the described embodiment of the variable valve timing system of the present invention, when the internal combustion engine is not operated, the operation fluid is returned to the oil reservoir 120 of the internal combustion engine from each advanced angle chamber R1, each retarded angle chamber R2, the lock groove 21*h* of the first controlling mechanism B1, and the lock groove 21*m* of the second controlling mechanism B2 through gaps formed amongst the various members. At an early stage of the internal combustion engine starting or operation, the operation fluid is not sufficiently discharged even though the oil pump 110 is actuated by the internal combustion engine. Further, the operation fluid is not sufficiently supplied to each advanced angle chamber R1, each retarded angle chamber R2, the lock groove 21*h* of the first controlling mechanism B1 and the lock groove 21*m* of the second controlling mechanism B2 from the fluid pressure circuit C even though the energization to the solenoid 103 of the fluid pressure controlling valve 100 is controlled by the energization controlling device 200. Accordingly, the relative rotation phase of the rotor member 20 with respect to the housing member 30 cannot be adjusted or maintained. If the relative rotation phase of the rotor member 20 with respect to the housing member 30 is not the intermediate lock phase, the housing member 30 and the rotor member 20 are relatively rotated by torque fluctuations affecting the camshaft.

In this manner, when the relative rotation phase of the rotor member 20 with respect to the housing member 30 is positioned at the intermediate lock phase, the lock plate 61 of the first controlling mechanism B1 is received in the lock groove 21*h* by the biasing force of the lock spring 62. Then, relative rotation to the advanced angle side is restricted. Also the lock plate 63 of the second controlling mechanism B2 is received in the lock groove 21*m* by the biasing force of the lock spring 64, and then relative rotation to the retarded angle side is restricted. Accordingly, relative rotation of the housing member 30 and the rotor member 20 is restricted and maintained at the intermediate lock phase by the first controlling mechanism B1 and the second controlling mechanism B2. Thus adequate variable valve timing is obtained for starting the internal combustion engine, and the starting performance of the internal combustion engine is improved.

With relative rotation of the rotor member 20 with respect to the housing member 30 being restricted by the first controlling mechanism B1 and the second controlling mechanism B2 at the intermediate lock phase as explained above, when the operation fluid is sufficiently supplied to each advanced angle chamber R1 through the first controlling mechanism B1 from the fluid pressure circuit C, the passage P1 functions as a throttle connecting the advanced angle chamber R1 with the first controlling mechanism B1. In the same say and under the same condition, when the operation fluid is sufficiently supplied to each retarded angle chamber R2 through the second controlling mechanism B2 from the fluid pressure circuit C, the passage P2 functions as a throttle connecting the retarded angle chamber R2 with the second controlling mechanism B2.

Then first, in the passages P1, P2 to which the operation fluid is supplied, the fluid pressure being provided for the first controlling mechanism B1 and the second controlling mechanism B2 is instantly obtained. Next, the unlock operation is immediately conducted as the lock plates 61, 63 are retracted and received in the retracting grooves 31*e*, 31*g* respectively by overcoming the force of the respective lock springs 62, 64. By virtue of the throttle function associated with the passage P1, P2, the supply of operation fluid is controlled to the advanced angle chamber R1 and the retarded angle chamber R2. The quantity of operation fluid supplied to the advanced angle chamber R1 is decreased by the throttling function of the passage P1 (the small notch 21*j*). However, the quantity of operation fluid supplied to the lock groove 21*h* is enough, and the lock plate 61 can move toward the retracting groove 31*e* by the pressure of the operation fluid filled in the lock groove 21*h*, so the first controlling mechanism is in the unlock operation. After the unlock operation of the first control mechanism, the operation fluid is filled into the advanced angle chamber B1 so as to rotate the rotor member 21.

Similarly, the quantity of operation fluid supplied to the retarded angle chamber R2 is decreased by the throttling function of the passage P2 (the small notch 21*p*). However, the quantity of operation fluid supplied to the lock groove 21*m* is enough, and the lock plate 63 can move toward the retracting groove 31*g* by the pressure of the operation fluid filled in the lock groove 21*m*, so the second controlling mechanism is in the unlock operation. After the unlock operation of the second control mechanism B2, the operation fluid is filled to the retarded angle chamber R2 so as to rotate the rotor member 21. Thus the relative rotation of the rotor member 20 and the housing member 30 is relatively slower compared to the unlock operation. Accordingly, when the phase is controlled for quick response, the lock plate 61 of the first controlling mechanism B1 and the lock plate 63 of the second controlling mechanism B2 cannot be caught in the relative rotation of the rotor member 20 and the housing member 30.

Under the condition above with the internal combustion engine being started and when the rotor member 20 is rotated to the advanced angle side or the retarded angle side from the intermediate lock phase relative to the housing member 30 by more than the predetermined amount as shown in FIGS. 4 and 5, the throttling function of the passages P1, P2 of the advanced angle side and the retarded angle side is canceled. Accordingly, when the rotor member 20 is rotated to the advanced angle side or the retarded angle side from the intermediate lock phase relative to the housing member 30 by more than the predetermined amount, the operation fluid is thoroughly supplied to the advanced angle chamber R1 or the retarded angle chamber R2 from the first controlling mechanism B1 or the second controlling mechanism B2 via the large notches 21*k*, 21*q* and the lock grooves

21*h,* 21*m,* or via the lock grooves 21, 21*m* directly. The cross-sectional area of the passage becomes larger and the quantity of the operation fluid is decreased. Then the rotor member 20 is rotated relative to the housing member 30 with a good response. Accordingly, certain or reliable unlock operation and good response can be obtained.

Meanwhile, when the internal combustion engine is under the normal operation condition (i.e., excluding the starting operation), the oil pump 110 is actuated by the internal combustion engine and the operation fluid is sufficiently discharged. Then the operation fluid is sufficiently supplied to each advanced angle chamber R1, each retarded angle chamber R2, the lock groove 21*h* of the first controlling mechanism B1, and the lock groove 21*m* of the second controlling mechanism B2 through the fluid pressure circuit C. Thus the rotation phase of the rotor member 20 relative to the housing member 30 can be adjusted and maintained at a desired phase within the range from the most retarded angle phase (the phase in which the volume of the advanced angle chamber R1 is a minimum and the volume of the retarded angle chamber R2 is a maximum) to the most advanced angle phase (the phase in which the volume of the advanced angle chamber R1 is a maximum and the volume of the retarded angle chamber R2 is a minimum) through the energization of the solenoid 103 of the fluid pressure controlling valve 100 being controlled by the energization controlling device 200. Under the normal operation condition of the internal combustion engine, the variable valve timing of the intake valve can be appropriately adjusted between the operation at the most retarded angle phase and the operation at the most advanced angle phase.

In this case, the rotation phase of the rotor member 20 to the advanced angle side relative to the housing member 30 is adjusted by the supply of the operation fluid to each advanced angle chamber R1 and the lock groove 21*h* of the first controlling mechanism B1 through the fluid pressure controlling valve 100, and by the discharge of the operation fluid from each retarded angle chamber R2 and the lock groove 21*m* of the second controlling mechanism B2 through the fluid pressure controlling valve 100.

At this time, under the following condition, the rotor member 20 is rotated to the advanced angle side relative to the housing member 30 because the operation fluid is supplied to each advanced angle chamber R1 and the lock groove 21*h,* and is discharged from each retarded angle chamber R2 and the lock groove 21*m.* The condition is that once the operation fluid is supplied to the lock groove 21*h* of the first controlling mechanism B1, the lock plate 61 is unlocked by overcoming the force of the lock spring 62 and is received in the retracting groove 31*e,* or is slidably in contact with the outer periphery of the main rotor 21 (as shown in FIG. 4). In addition, the lock plate 63 is slidably in contact with the outer periphery of the main rotor 21 or is slidably in contact with the bottom surface of the lock groove 21*m* (as shown in FIG. 4).

The rotation phase of the rotor member 20 to the retarded angle side relative to the housing 30 is adjusted by the supply of the operation fluid to each retarded angle chamber B2 and the lock groove 21*m* of the second controlling mechanism 32 and by the discharge of the operation fluid from each advanced angle chamber R1 and the lock groove 21*h* of the first controlling mechanism B1 through the fluid pressure controlling valve 100.

At this time, under the following condition, the rotor member 20 is rotated to the retarded angle side relative to the housing member 30 because the operation fluid is supplied to each retarded angle chamber R2 and the lock groove 21*m,* and is discharged from each advanced angle chamber R1 and the lock groove 21*h.* The condition is that once the operation fluid is supplied to the lock groove 21*m* of the second controlling mechanism B2, the lock plate 63 is unlocked by overcoming the force of the lock spring 64 and is received in the retracting groove 31*g,* or is slidably in contact with the outer periphery of the main rotor 21 (as shown in FIG. 5). In addition, the lock plate 61 is slidably in contact with the outer periphery of the main rotor 21 or is slidably in contact with the bottom surface of the lock groove 21*h* (as shown in FIG. 4).

In the embodiment of the variable valve timing system of the present invention described above, the housing member 30 is integrally rotated with the crankshaft, and the rotor member 20 is integrally rotated with the camshaft 10. However, the present invention has useful application to another type of variable valve timing system in which the housing member is integrally rotated with the camshaft and the rotor member is integrally rotated with the crankshaft. The present invention can also be used in connection with variable valve timing systems in which the vane is formed as a unit with the rotor body.

In the lock phase, the torque fluctuation of the camshaft rotates the rotor member 21, and the pressure of the operation fluid filled in the advanced angle chamber R1, or the retarded angle chamber R2, is increase because the volume of the advanced angle chamber R1, or the retarded angle chamber R2, is made smaller or reduced by the rotation of the vanes 23. The pressure of the operation fluid causes movement (unlock operation) of the lock member 31*e,* 31*g* because the advanced angle chamber R1 or the retarded angle chamber R2 communicates with the lock groove 21*h,* 21*m* via the passage P1, P2 respectively. However, the throttling function of the small notch 21*j,* 21*p* prevents the transmission of the pressure. Therefore, the first and second control mechanisms do not operate without supplying operation fluid via the passage 21*d,* 21*g.*

Although the present invention is described above as being applied to the variable valve timing system equipped with the camshaft for controlling the opening and the closing of the intake valve, the present invention can also be applied to variable valve timing systems quipped with the camshaft for controlling the opening and closing of the exhaust valve.

The principles, preferred embodiment and modes of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A variable valve timing system comprising:

a housing member rotatable as a unit with either a crankshaft or a camshaft of an internal combustion engine;

a rotor member relatively rotatably assembled on a shoe portion of the housing member and forming an advanced angle chamber and a retarded angle chamber at a vane portion in the housing member, said rotor member rotating as a unit with either the crankshaft or the camshaft of the internal combustion engine;

a relative rotation controlling mechanism allowing relative rotation of the housing member and the rotor member by an unlock operation through supply of an operation fluid, and restricting relative rotation of the housing member and the rotor member by a lock operation through discharge of the operation fluid at a lock phase within an intermediate area from a most advanced angle phase to a most retarded angle phase excluding rotation limited phases of both ends;

a fluid pressure circuit for controlling the operation fluid to be supplied to and discharged from the advanced angle chamber, the retarded angle chamber, and the relative rotation controlling mechanism;

the relative rotation controlling mechanism being formed with a first controlling mechanism restricting the relative rotation to an advanced angle side when the first controlling mechanism is operated under the lock operation at the lock phase, and a second controlling mechanism restricting the relative rotation to a retarded angle side when the second controlling mechanism is operated under the lock operation at the lock phase;

the fluid pressure circuit supplying and discharging the operation fluid to or from the advanced angle chamber through the first controlling mechanism, and supplying and discharging the operation fluid to or from the retarded angle chamber through the second controlling mechanism;

a first passage connecting the advanced angle chamber with the first controlling mechanism and functioning as a throttle; and a second passage connecting the retarded angle chamber with the second controlling mechanism and functioning as a throttle.

2. The variable valve timing system according to claim 1, wherein the throttle function of the first passage is canceled when the rotor member is rotated relative to the housing member to the advanced angle side from the lock phase by more than a predetermined amount, and the throttle function of the second passage is canceled when the rotor member is rotated relative to the housing member to the retarded angle side from the lock phase by more than the predetermined amount.

3. The variable valve timing system according to claim 1, wherein each of the first and second controlling mechanisms includes a spring and a lock plate slidably positioned in a radially directed retracting groove formed in the housing member.

4. The variable valve timing system according to claim 3, wherein each lock plate includes an end portion slidably positionable in a respective lock groove formed in the rotor member.

5. The variable valve timing system according to claim 4, wherein one of the lock grooves has a sloping bottom surface extending from a deepest portion and becoming more shallow towards the retarded angle side, the other lock groove having a sloping bottom surface extending from a deepest portion and becoming more shallow towards the advancing angle side.

6. The variable valve timing system according to claim 4, wherein each of the lock grooves has a sloping bottom surface extending from a deepest portion, the deepest portion of each lock groove being positioned in opposition to the respective retracting grooves when the rotor member is positioned at the lock phase relative to the housing member.

7. The variable valve timing system according to claim 4, wherein the first passage connects one of the lock grooves to the advanced angle chamber and the second passage connects the other lock groove to the retarded angle chamber.

8. A variable valve timing system comprising:

a housing member rotating as a unit with either a crankshaft or a camshaft of an internal combustion engine;

a rotor member relatively rotatably assembled on a shoe portion of the housing member and forming an advanced angle chamber and a retarded angle chamber at a vane portion in the housing member, said rotor member rotating as a unit with either the crankshaft or the camshaft of the internal combustion engine;

a relative rotation controlling mechanism allowing relative rotation of the housing member and the rotor member by an unlock operation through supply of an operation fluid, and restricting the relative rotation of the housing member and the rotor member by a lock operation through the discharge of the operation fluid at a lock phase within an intermediate area from a most advanced angle phase to a most retarded angle phase excluding rotation limited phase at both ends;

a fluid pressure circuit controlling the operation fluid to be supplied to and discharged from the advanced angle chamber, the retarded angle chamber, and the relative rotation controlling mechanism;

the relative rotation controlling mechanism comprising a first controlling mechanism restricting the relative rotation to an advanced angle side when the first controlling mechanism is operated under the lock operation at the lock phase, and a second controlling mechanism restricting the relative rotation to a retarded angle side when the second controlling mechanism is operated under the lock operation at the lock phase;

the fluid pressure circuit supplying and discharging the operation fluid to or from the advanced angle chamber through the first controlling mechanism, and supplying and discharging the operation fluid to or from the retarded angle chamber through the second controlling mechanism;

a first passage having a first narrow portion which communicates between the advanced angle chamber and the first controlling mechanism; and a second passage having a second narrow portion which communicates between the retarded angle chamber and the second controlling mechanism.

9. The variable valve timing system according to claim 8, further comprising:

a first wide portion disposed next to the first narrow portion;

a second wide portion disposed next to the second narrow portion;

the first narrow portion being disposed a predetermined distance toward the advanced angle side; and the second narrow portion being disposed a predetermined distance toward the retarded angle side.

10. The variable valve timing system according to claim 8, wherein the first passage also includes a first wide portion disposed in series with the first narrow portion in a peripheral direction of the rotor member, the first wide portion having a greater cross-sectional area than the first narrow portion.

11. The variable valve timing system according to claim 8, wherein the second passage also includes a second wide portion disposed in series with the second narrow portion in a peripheral direction of the rotor member, the second wide portion having a greater cross-sectional area than the second narrow portion.

12. The variable valve timing system according to claim 8, wherein each of the first and second controlling mechanisms includes a spring and a lock plate slidably positioned in a radially directed retracting groove formed in the housing member.

13. The variable valve timing system according to claim 12, wherein each lock plate includes an end portion slidably positionable in a respective lock groove formed in the rotor member.

14. The variable valve timing system according to claim 13, wherein one of the lock grooves has a sloping bottom surface extending from a deepest portion and becoming more shallow towards the retarded angle side, the other lock groove having a sloping bottom surface extending from a deepest portion and becoming more shallow towards the advancing angle side.

15. The variable valve timing system according to claim 13, wherein each of the lock grooves has a sloping bottom surface extending from a deepest portion, the deepest portion of each lock groove being positioned in opposition to the respective retracting grooves when the rotor member is positioned at the lock phase relative to the housing member.

16. The variable valve timing system according to claim 13, wherein the first passage connects one of the lock grooves to the advanced angle chamber and the second passage connects the other lock groove to the retarded angle chamber.

* * * * *